United States Patent [19]

McVay et al.

[11] Patent Number: 4,632,175

[45] Date of Patent: Dec. 30, 1986

[54] CONTINUOUS CASTING MACHINE

[75] Inventors: James D. McVay, Youngwood; Hermann Take, Pittsburgh, both of Pa.

[73] Assignee: Continuous Casting Systems Inc., Pittsburgh, Pa.

[21] Appl. No.: 732,503

[22] Filed: May 9, 1985

[51] Int. Cl.[4] ..... B22D 11/08; B22D 11/128

[52] U.S. Cl. ..... 164/426; 164/442; 164/446; 164/448

[58] Field of Search ..... 164/426, 446, 425, 445, 164/483, 442, 448

[56] References Cited

U.S. PATENT DOCUMENTS

| | | | |
|---|---|---|---|
| 2,920,359 | 1/1960 | Easton et al. | 164/425 X |
| 3,370,641 | 2/1968 | Greenberger | 164/426 X |
| 3,521,697 | 7/1970 | Niskovskikh et al. | 164/445 |
| 3,608,619 | 9/1971 | Bollig et al. | 164/426 |
| 3,930,533 | 1/1976 | Rokop et al. | 164/426 |
| 4,043,383 | 8/1977 | Isenberg et al. | 164/426 |
| 4,074,745 | 2/1978 | Scheurecker et al. | 164/446 |
| 4,286,649 | 9/1981 | Rokop et al. | 164/426 X |
| 4,290,479 | 9/1981 | Colombo | 164/446 X |
| 4,291,748 | 9/1981 | Langner | 164/426 |
| 4,383,571 | 5/1983 | Frantz et al. | 164/446 |
| 4,498,520 | 2/1985 | Colombo | 164/426 |

*Primary Examiner*—Nicholas P. Godici
*Assistant Examiner*—J. Reed Batten, Jr.
*Attorney, Agent, or Firm*—Fred Wiviott

[57] ABSTRACT

A continuous casting machine has a flow through mold and a flexible starting bar composed of a plurality of short sections coupled by hinges which permit the sections to pivot inwardly to a slight degree but prevent outward pivotal movement beyond the machine's arcuate casting path. A storage assembly for the starter bar includes a pair of support stands each having spaced drive rolls disposed along the arcuate casting path through which the starter bar passes as it is moved into and out of its stored position. One roll of each stand is fixed and the other is mounted on a pivotal arm engaged by a hydraulic cylinder to provide a pinching effect on the starter bar as it is moved between its operative and stored positions.

17 Claims, 13 Drawing Figures

CONTINUOUS CASTING MACHINE

BACKGROUND OF THE INVENTION

This invention relates to continuous casting machines of the type designed to cast billets, blooms and slabs, for example, and more particularly to a continuous casting machine starting bar and starting bar storage system.

Continuous strands of cast metal, such as steel, are produced by pouring molten metal into the open upper end of a flow-through casting mold and withdrawing the metal in a continuous strand from the opening in the bottom of the mold. The molten metal is delivered to the upper end of the mold by a tundish, which in turn, receives metal from the ladle used to transport the metal from the melting furnace.

Initially, the lower end of the mold is closed by a starting bar which extends downwardly from the mold and through an arcuate guide assembly. When the end of the starting bar emerges from the open lower end of the mold, it is followed by the cast strand. As the joined ends of the cast product and starting bar move beyond the position of the withdrawal straightener mechanism rollers the two are disconnected by means of a separate mechanical device, so that the strand can pass to a run-out table where it is cut into suitable lengths while the starting bar continues its movement along a separate path into its storage position.

Some prior art continuous casting machines employ in arcuate guiding system, located between the mold and withdrawal straightener mechanism, for the purpose of guiding the cast strand as it exits the mold in a generally downward direction along with providing support for the starting bar chain during commencement of the casting sequence along with providing support during insertion of the starting bar into position prior to the start of the casting process.

Two types of starting bars which satisfy this requirement are in common use. These include a rigid bar having a curvature which conforms to the arc described by the radius of the casting machine, and a flexible bar formed of a plurality of links which assume the contour of the support assembly through which it passes.

Examples of rigid curved starting bars are shown in U.S. Pat. Nos. 3,344,844; 3,370,641; 3,433,287; 3,628,595; 3,658,120; 3,930,533; 4,286,649; and 4,412,579. These bars may be fabricated as a unitary member or may be composed of a number or rigidly secured segments as shown in U.S. Pat. No. 4,043,383. Examples of flexible starting bars are shown in U.S. Pat. Nos. 3,426,835; 3,495,651; 4,291,748; 4,382,462; 4,425,960; and 4,457,353. Some prior art flexible starting bars are semi-rigid; that is, they are constructed and arranged to provide only a limited degree of flexibility as shown in U.S. Pats. Nos. 2,920,359; 3,608,619, and 4,383,571.

Each of the prior art casting machines discussed above requries a complicated and costly assembly for moving the starting bar away from the withdrawal rolls and for supporting the starting bar in its storage position. In addition, prior art starting bars are relatively complicated and expensive to manufacture. Further, prior art flexible starting bars require a curved guiding and supporting mechanism between the bottom of the mold and the entrance end of the withdrawal straightener unit, are expensive, and require costly and time consuming maintenance procedures int he event of a hot metal spill or a break out of a newly cast metal strand.

SUMMARY OF THE INVENTION

It is an object of the invention to provide a new and improved starting bar system for continuous casting machines.

A further object of the invention is to provide a starting bar system which can be readily adapted for use in continuous casting machines of the type which utilize either a curved or a straight mold.

A still further object of the invention is to provide a starting bar system for continuous casting machines which does not require elaborate guiding and support mechanisms between the mold and the withdrawal straightener unit.

Another object of the invention is to provide a starting bar storage system relatively simplified and positioned in such a manner as to be free and clear of that of other mechanisms associated with continuous casting machines, thereby reducing congestion and the possibilities of damage resulting from congestion.

Still another object of the invention is to provide a continuous casting machine starter bar system which is simplified in design, thereby expensive to manufacture.

In general terms, the invention comprises a continuous casting machine having a mold oriented generally vertically and a starting bar comprising a plurality of pivotally interconnected links. The pivot axes of pivotally connected adjacent link pairs extends perpendicular to the axis of the casting path, and each of the links has first and second abutment surfaces at each end. Support means are disposed generally below the mold for supporting spaced apart points on the starting bar along the casting path with one end oriented generally vertically below the open lower end of the mold and the opposite end extending in generally horizontal direction. The first abutment surface on one link engages the first abutment surface on the adjacent link to limit pivotal movement of the links in an outward direction so that the unsupported portions of the starting bar will have a free form that lies along the casting radius. The second abutment surface at the end of each link engages the second abutment surface on the adjacent link when the links pivot inwardly from the casting path and are out of engagement when the first abutment surface is engaged, whereby slight pivotal movement of the links out of alignment with the casting path is permitted but outward pivotal movement of the links is arrested when the curvature of the casting path is reached.

DETAILED DESCRIPTION OF THE PREFERRED EMBODIMENT

Figure 1:
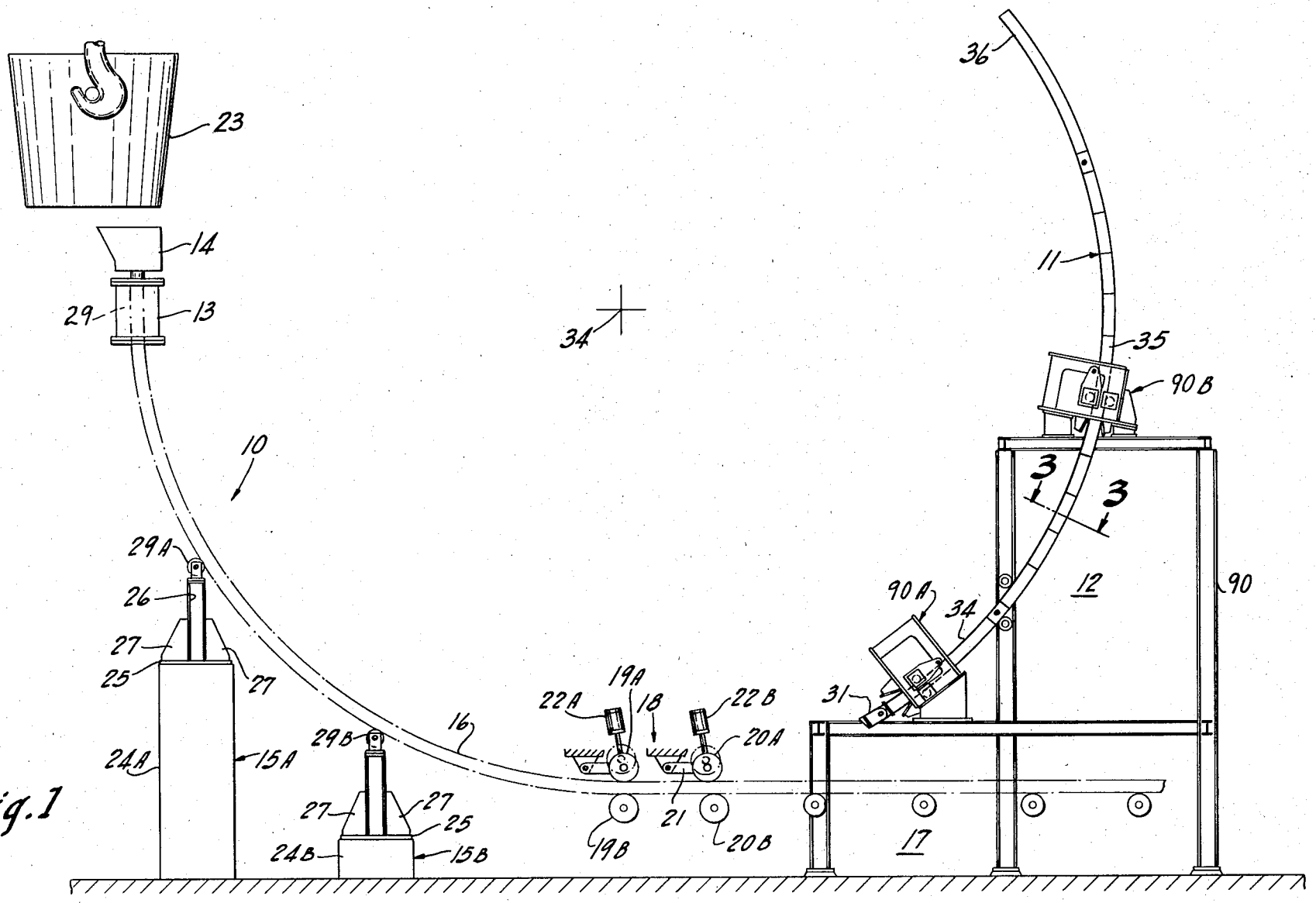
FIG. 1 schematically illustrates a side elevational view of a continuous casting machine which incorporates the starting bar and storage assembly in accordance with the preferred embodiment of the invention.
Figure 13:
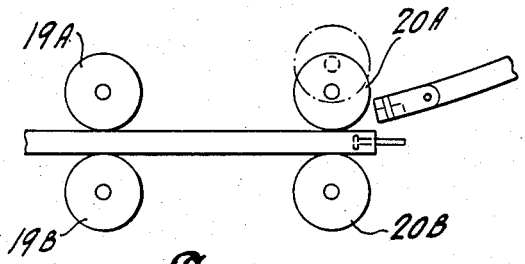

A casting machine 10 which includes a starting bar 11 and a storage apparatus 12 in accordance with the invention, is shown schematically in FIG. 1. In general terms, the casting machine 10 includes a vertically oriented flow-through mold 13 which is disposed below a tundish 14. A pair of support strands 15A and 15B are disposed below the mold 13 and each is positioned for supporting the starting bar 11 and the cast strand 16 as they exit the mold 13 and are delivered to the storage assembly 12 or the run out and cutting table 17. Disposed between the supports 15A, 15B and the run out and cutting table 17 is a withdrawal and straightener assembly 18 which includes opposed rolls 19A, 19B and 20A, 20B. The lower rolls 19B and 20B may for example be mounted for rotation about fixed axes while the upper rolls 19A and 20A are mounted on frames (not shown) which are urged by pressure exerting means, such as hydraulic cylinders 22A, 22B, into engagement with the strand 16. The rolls may also be driven for exerting a withdrawal force on the strand 16 or the starting bar 11 to withdraw the same from mold 13 and for feeding the same to the runout table 17 or the storage assembly 12. Roll 20A is also mounted on a pivot arm 21 for movement under the influence of cylinder 22B between its full and broken line positions shown in FIGS. 1 and 13.

As those skilled in the art will appreciate, the mold 13 may be mounted on a vibrator assembly (not shown) which moves the mold 13 relative to the strand 16 to prevent adherence therebetween. A ladle 23 is supported in any suitable manner, such as by a crane, so that molten metal may be transported between the melting furnace (not shown) and the tundish 14. A second ladle (not shown) may be in transit between the melting furnace and the continuous casting machine 10 to provide a continuous delivery of molten metal.

The support strands 15A and 15B respectively include pedestals 24A and 24B, each of which has a post 26 extending vertically upward from its upper end. Each post 26 is secured to a base plate 25 mounted atop the pedestals 24A and 24B and each is reinforced by vertical side ribs 27. Rollers 29A and 29B are respectively mounted at the upper ends of the posts 26 of strands 15A and 15B. As seen in FIG. 1, the pedestal 24A has a greater height than pedestal 24B so that the rollers 29A and 29B of support stands 15A and 15B define two points on a vertically curved path.

The mold 13 has an arcuate passage 29 with openings at its upper and lower ends. The curvature of the mold passage defines an arcuate casting path comprising points equidistant from the mold passage center of curvature 34. The rollers 29A and 29B define two points on this path and the rollers 19A and 20A two additional points.

As those skilled in the art will appreciate, when the casting operation is commenced, the head 31 of starting bar 11 is disposed in the open lower end of the mold 13. The bar 11 extends downwardly from the mold 13 and along the casting path where it engages the rollers 29A and 29B and with its opposite end disposed between the rollers 19A, 19B and 20A, 20B. The molten metal to be cast is discharged from ladle 23 into tundish 14 from which it is fed into the open upper end of mold 13. As the metal begins to solidify from its outer surface inwardly, the withdrawal rollers 19A, 19B and 20A, 20B are actuated to withdraw the starting bar head 31 from the lower end of mold 13. As the head 31 exits the mold 13, it is followed by the partially solidified strand 16. A vibrator assembly (not shown) vibrates the mold to prevent the strand 16 from adhering thereto. The metal is fed into the upper end of the mold 13 from the tundish 14 at the same rate as it is withdrawn as a strand 16 from the lower end to insure continuous operation.

As the starting bar 11 is withdrawn, it will follow the arcuate path defined by the support assembly 12 and into the storage position as shown by full lines in FIG. 1. To permit the starting bar to travel in this path, the roller 20A is initially in an elevated position. As will be discussed more fully below, when the head 31 of the starting bar passes the roller 20A, the latter is pivoted from its position shown by broken lines in FIG. 1 to its full line position so as to separate the starting bar 11 from the strand 16. With the roller 20A in this position the strand 16 is straightened and passes to the runout table 17.

The starting bar 11 is shown in FIG. 1 to comprise the head section 31, a first rigid arcuate section 34 pivotally coupled at one end to the head section 31. At its opposite end, the section 34 is coupled to a hinged section 35, the other end of which is coupled to one end of a second arcuate rigid section 36.

Figure 3:
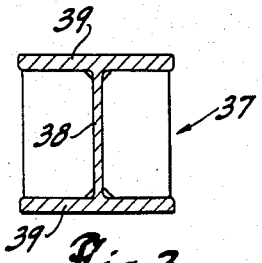
FIG. 3 is a view taken along line 3—3 of FIG. 1.
Figure 2:
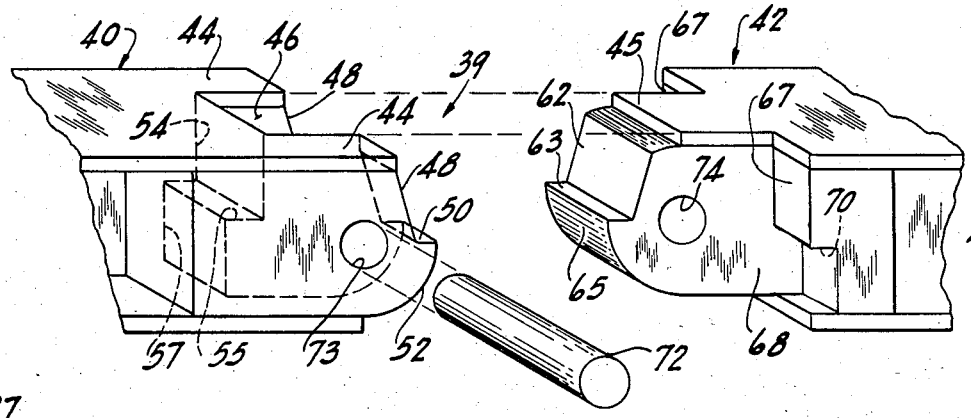
FIG. 2 is an exploded perspective view of a portion of the starting bar shown in FIG. 1.
Figure 4:
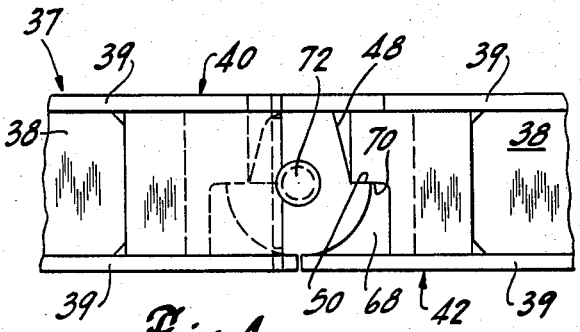
FIG. 4 is a side view of a portion of the starting bar shown in FIG. 2.
Figure 5:
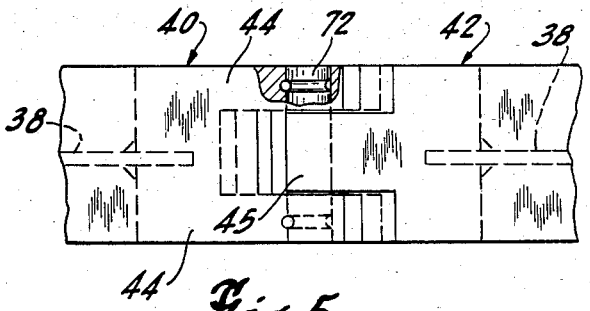
FIG. 5 is a top plan view of the section shown in FIG. 4.

The hinged section 35 comprises a plurality of short members 37 which may have any convenient shape, such as for example, short I-beam sections as seen in FIG. 3. Each member 37 has a center webb 38 which interconnect flanges 39. In addition, a first end piece 40 is disposed at one end of each section 37 and a second end piece 42 is located at the other end, as seen in FIGS. 2 and 4–6. End piece 40 has a pair of forwardly projecting portions 44 which define a groove 46 therebetween for receiving a tongue 45 projecting from the end piece 42 of the next adjacent member 37. The end pieces 40 and 42 are configured so that pivotal movement will be limited whereby the bar will be self-supporting at the machine casting path with limited pivotal movement inwardly therefrom. In particular, each of the forwardly projecting portions 44 has a front face 48 which slopes upwardly and rearwardly from a laterally extending abutment surface 50 located at about the mid-height of end piece 40. Extending downwardly and rearwardly from abutment surface 50 is an arcuate surface 52. The inner end of goove 46 terminates in a surface 54 which is generally perpendicular to a plane containing surface 50. Extending rearwardly from surface 54 is a third abutment surface 55 which defines a recess 57 communicating with the lower portion of groove 46. The tongue 45 is formed similarly to projecting portions 44 in that it includes a sloping front face 62, a laterally extending abutment surface 63 and an arcuate surface 65. At the rear of the tongue 45 there are a pair of abutment surfaes 67 in an opposed relation to surfaces 48 of projecting portions 44 and a recess 68 is formed below each surface 67 to define an abutment surface 70 perpendicular to surface 67 and disposed in an opposed relation to abutment surfaces 50. A pin 72 extends through aligned openings 73 and 74 in the projecting portions 44 and the tongue 45 for pivotally connecting the end pieces 40 and 42. Spring pins lock the pin 72 in position.

Figure 8:
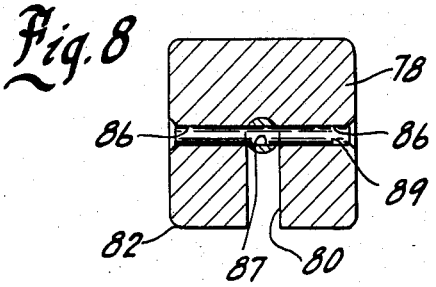
FIG. 8 is a view taken along line 8—8 of FIG. 7.
Figure 7:
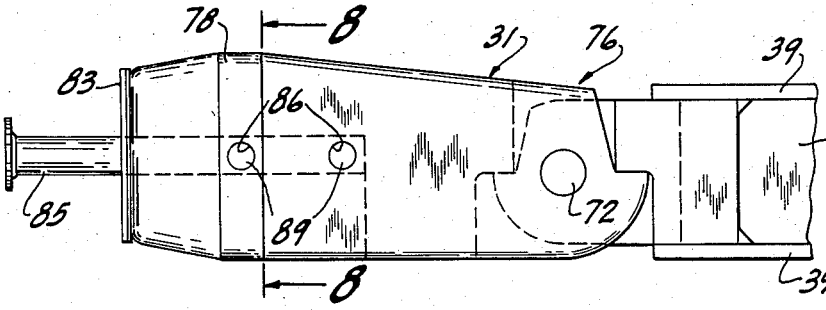
FIG. 7 shows the head section of the starter bar illustrated in FIG. 1.

As seen in FIGS. 7 and 8, the head 31 is coupled to the arcuate section 34 by a pivotal coupling 72 similar to the pivotal couplings 72 which interconnects the members 40 and 42. Accordingly, the connection 72 will not be discussed in detail. The head 31 includes a main body 78 having a longitudinal slot 80 which extends upwardly from its lower and front surfaces 82 and 83, respectively. A pin 85 is disposed within slot 80 and projects beyond the front surface 83 and in a generally axial direction. Pairs of aligned openings 86 are formed through the head 78 and each pair is coaxial with an opening 87 in pin 85. Extending through each group of aligned openings 86 and 87 is a dowel pin 89 for retaining the pin 85 in the position shown.

It can be seen that outward pivotal movement past the machine casting path curvature is prevented by the engagement of surfaces 50 and 70 on one side of pin 72 and surfaces 55 and 63 on the other. Similarly, inward pivotal movement is limited by the engagement of surfaces 48 and 67 on one side of pin 72 and 54 and 62 on the other. This minimizes stresses on the pin. Also, the tongue-in-groove connection of the links 37 provides a substantially continuous contact surface for the rollers of the withdrawal assembly 18 and the storage assembly 12.

The storage assembly 12 inlcudes a frame 90 for supporting a pair of drive units 90A and 90B along the casting path defined by the mold, passage 29 and the rollers 29A and 29B. The drive units 90A and 9B are identical accordingly only unit 90A will be described in detail for the sake of brevity.

Figure 9:
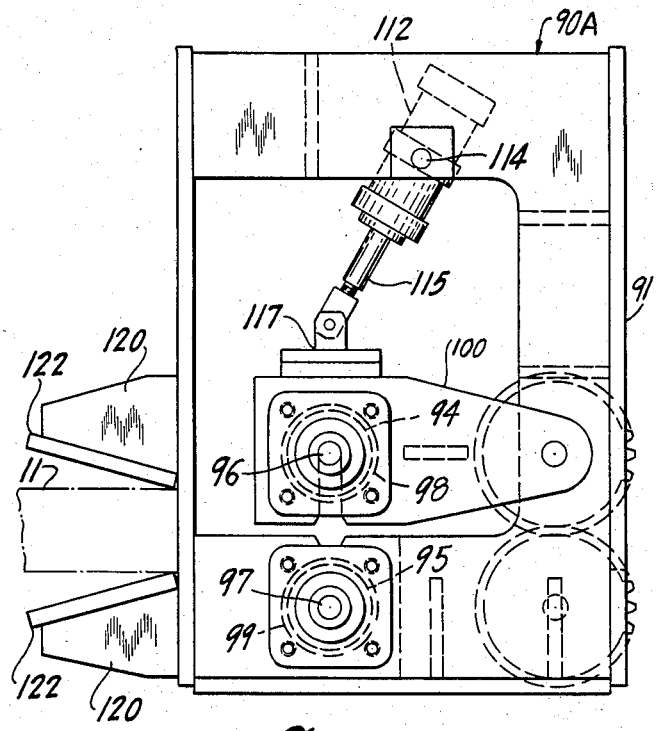
FIG. 9 is a side elevational view with a portion of the storage assembly of the casting machine shown in FIG. 1.
Figure 10:
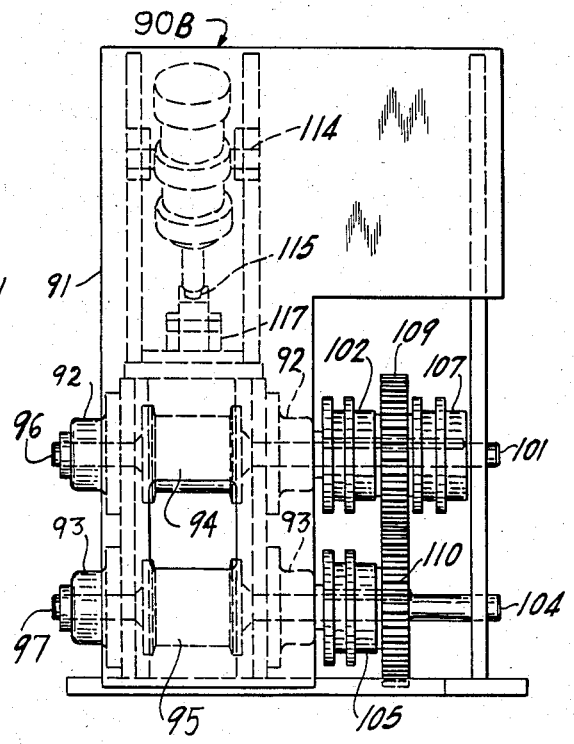
FIG. 10 is a front view of the storage assembly component shown in FIG. 9.
Figure 11:
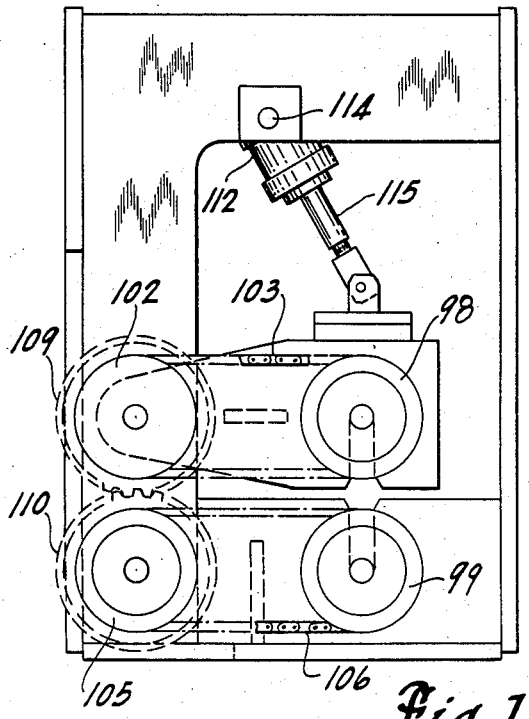
FIG. 11 shows the drive assembly of the storage assembly component illustrated in FIGS. 9 and 10.
Figure 12:
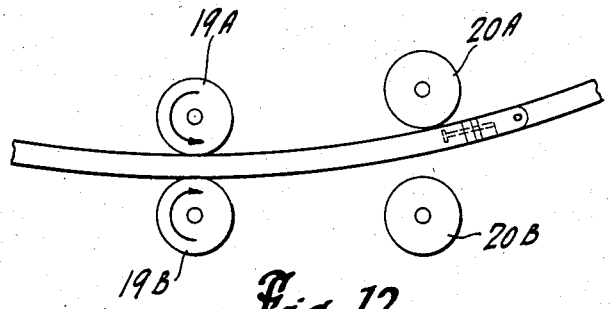
FIGS. 12 and 13 illustrate the operation of a portion of the casting machine illustrated in FIG. 1.

Drive unit 90A is shown in FIGS. 9–11 to include a frame 91 having pairs of opposed bearings 92 and 93 which rotatably support a pair of flanged rollers 94 and 95 on shafts 96 and 97. Also mounted on shafts 96 and 97, respectively, are pulleys 98 and 99.

The bearings 93 are fixed but bearings 92 are mounted on pivot arms 100 which pivot about a shaft 101 rotatably mounted on frame 91 in parallel spaced relation with respect to shafts 96 and 97. This permits the application of pressure to the upper and lower flanges 39 so that the starting bar 11 can be controlled during the time that it is within the confines of the drive units 90A and 90B. Also mounted on shaft 101 is a second pulley 102 which is coupled to pulley 98 by a belt or chain 103. A fourth shaft 104 is also mounted on frame 91 parallel to shaft 101 and has a pulley 105 mounted thereon which is coupled by a belt or chain 106 to pulley 99. The shaft 101 is also coupled to a drive motor (not shown) by a second pulley 107 and a belt or chain (not shown). Finally, meshing gears 109 and 110 mounted on the shafts 101 and 104, respectively, interconnect the two so that both may be rotated by the drive motor (not shown).

Driving pressure is applied to the member 37 by means of a hydraulic cylinder 112 pivotally mounted by means of trunnion pins 114 pivotally mounted on the frame 84. Extending from cylinder 112 is a piston rod 115, the other end of which is coupled to a bracket 117 fixed to the arm 100. Also mounted on frame 91 and in alignment with the gap between the rollers 94 and 95 are a pair of inlet guides 120 each having an obliquely extending guide plate 122. The inner ends of the plates 122 and the rollers 94 and 95 lie along the opposite sides of the casting radius of the machine 10 and the path movement of bar 11.

Prior to the commencement of the casting operation, the starting bar is held in the position shown in FIG. 1 by cylinders 112. When the operating sequence is commenced, the cylinders 22A and 22B are actuated to move the rollers 19A and 20A to their positions shown by broken lines in FIG. 1. This allows sufficient clearance to permit the free passage of the starting bar 11. After the rollers 19A and 20A have been elevated, the hydraulic pressure exerted by the cylinders 112 in both of the drive units 90A and 90B is reduced to convert the clamping forces into a force sufficient to permit full control of the starting bar 11 during insertion by balancing out the over running load due to the mass of the starting bar itself. At this point, air cylinders (not shown) are activated to retract locking pins (not shown) so that the starting bar 11 is permitted to move downwardly under the influence of gravity. A D.C. drive motor which is coupled to each of the pulleys 107 of units 90A and 90B are operated to begin rotating each of the rollers 94 and 95. As a result, the head 31 of the starting bar moves downwardly through the withdrawal and straightener mechanism 18 and toward the lower end of the mold 13. As the head 31 moves through the withdrawal and straightener mechanism 18 in a direction opposite from that of the casting direction and passes beyond the plane described by the vertical center line of roll 19B, the cylinder 22A is actuated to move the roller 19A downwardly until it engages the upper surface of the bar 11. A sufficient force is applied to balance out the overrunning load due to the mass of the starter bar assembly. The starter bar 11 is then propelled until the head 31 reaches the lower end of the mold 13. At this point, the bar 11 is jogged into position where the head 31 is at the proper elevation inside the mold by operation of the rolls 19A and 19B.

When the casting operation is commenced, the end 31 of the starting bar 11 is disposed within the open lower end of the mold 13. The opposite end 36 of bar 11 is disposed between the drive rollers 19A, 19B and 20A, 20B. Additionally, the roller 20A is in its elevated position. Molten metal may then be discharged from the ladle 23 into the tundish 14 from which it flows into the open upper end of mold 13.

As the molten metal within the mold 13 begins to solidify around the pin 85 extending from the head 31 of bar 11, the rollers 19A and 19B are operated so that the bar is withdrawn followed by the partially solidified strand. While the bar is positioned between the mold 13 and the rollers 19A, 19B each of the segments 37 will be in their full outwardly rotated position relative to each other so that the abuting surfaces 50 of end pieces 40 will engage the surfaces 70 and the abuting surfaces 63 of each end piece 42 will engage the surface 55. Each of the segments will then be in its position shown in FIG. 4 in which case, the bar 11 will be self supporting between support points and conform to the arcuate casting path. As the result, only minimum support is required by the rollers 29A and 29B.

As the bar 11 is moved toward the first drive assembly 90A, it will follow the arc described by the radius of the casting machine and move between the guide plates 122 of the first drive 90A. This will continue as the starting bar head 31 moves toward the drive rolls 19A and 19B.

Figure 6:
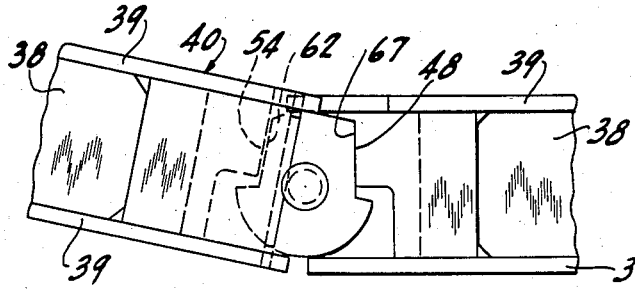
FIG. 6 shows the starting bar segment of FIG. 4 in a pivoted position.

Just prior to the time when the head 31 is between the rollers 19A and 19B the cylinders 112 are each actuated to provide contact between rolls 94 and 95 and the starter bar 11 so that the weight of the bar will now be controlled by the drive assemblies 90A, 90B. Meanwhile the juncture between the head 31 and the newly cast strand 16 will proceed through the withdrawal straightener assembly 18 until the head 31 passes the elevated roller 20A. A limit switch (not shown) is then activated by the starter bar 11 and in turn causes the hydraulic cylinder 22B from its broken line position in FIG. 13 downwardly to the point where roller 20A contacts the newly cast strand 16. When the roller 20A descends it shears the dowel pins 89 whereby the pin 85 separates from the head 31 and simultaneously, the strand 16 is straightened about the center line of roll 19B. The forward end of the strand passes on to the run out table 17 while the bar 11 proceeds up through the drive assemblies 90A and 90B. Meanwhile, the drive assemblies 90A, 90B propel the starting bar 11 to its storage position shown in FIG. 1. Because the pivotal movement of the members 37 are limited as shown in FIG. 6 by the engagement of the surfaces 48 and 54 on end member 40 with the surfaces 67 and 62 on the end member 42 as shown in FIG. 6, the result is that the starting bar 11 is substantially self supporting in the stored position.

When the starting bar 11 reaches the fully retracted position shown in FIG. 1 a limit switch (not shown) is actuated by the starting bar 11 whereby hydraulic pressure of the cylinders 112 in both drive units 90A, 90B is increased to create a clamping force sufficient to hold a starting bar assembly in this stored position. When this preset pressure is reached, air cylinders (not shown) are activated to push locking pins (not shown) in place to hold the starting bar in this position.

We claim:

1. A continuous casting machine for casting elongate metallic members includes a mold oriented generally vertically and having an arcuate passage with openings at its upper and lower ends, the curvature of the mold passage defining an arcuate casting path for the machine comprising points equidistant from the center of curvature of the mold passage.

a starting bar comprising a plurality of pivotally interconnected links, the pivotal connection between adjacent links defining pivot axes, the pivot axes of the pivotally connected adjacent link pairs extending perpendicular to the axis of the casting path, each of said links having first and second abutment surfaces at each end, a plurality of spaced apart support means disposed generally below the said mold for supporting spaced apart points on said starting bar along the casting path with one end of said starting bar oriented generally vertically below the open lower end of the mold and the opposite end extending in generally horizontal direction, said starting bar being unsupported between said support means, the first abutment surface on each link engaging the first abutment surface on the adjacent link to limit pivotal movement of the links outwardly relative to said center of curvature so that the unsupported portions of the starting bar define an arc whose radius of curvature is equal to that of the casting path, the second abutment surface at the end of each link engages the second abutment surface on the adjacent link when the links pivot inwardly from said casting path and are out of engagement when the first abutment surface is engaged, whereby slight inward pivotal movement of the links out of alignment with the casting path is permitted but outward pivotal movement of the links is arrested when the curvature of the casting path is reached, so that said starting bar will have a free form corresponding to the casting path, storage means located above the casting path and including first and second clamping means disposed in spaced apart relation along a continuation of the arcuate casting path for supportingly engaging spaced apart portions of said starting bar, the remaining portions of said starting bar being substantially self-supporting, and withdrawal means for moving said starting bar from a position below said mold into said storage means.

2. The casting machine set forth in claim 1 wherein said support means comprises at least a pair of rollers spaced apart below, and adjacent said casting path, said starting bar engaging said rollers and being self-supporting except for said rollers.

3. The casting machine set forth in claim 1 wherein each of the clamping means comprises first and second roller means for engaging the opposite sides of said starting bar, means for driving said roller means for moving said starting bar away from said withdrawal means, and including means for adjusting the clamping force between said roller means and the starting bar for controlling the rate at which the starting bar will be moved downwardly by gravity toward said withdrawal means.

4. The casting machine set forth in claim 3 wherein each of said clamping means includes a pivotally mounted arm, one of said roller means being mounted on said arm, and means for engaging said arm to urge the same into engagement with said starting bar.

5. The casting machine set forth in claim 4 wherein each of said links includes upper and lower generally parallel flanges to define upper and lower surfaces on said starting bar, the roller means of said storage means engaging said flanges.

6. The casting machine set forth in claim 5 wherein said support means comprises at least a pair of rollers spaced apart below said mold and along said casting path, one of said flanges on each link engaging said rollers, the remaining portions of said starting bar being self supporting between said pair of rollers.

7. A continuous casting machine includes a mold oriented generally vertically and having an arcuate passage with openings at its upper and lower ends, the curvature of the mold passage defining an arcuate casting path for the machine comprising points equidistant from the center of curvature of the mold passage, a starting bar comprising a plurality of pivotally interconnected links, the pivotal connection between adjacent link pairs defining pivot axes, the pivot axes of pivotally connected adjacent link pairs extending perpedicular to the axis of the casting path, each of said links having first and second abutment surfaces at each end, support means disposed generally below the said mold for supporting spaced apart points on said starting bar along the casting path with one end oriented generally vertically below the open lower end of the mold and the opposite end extending in a generally horizontal direction, the first abutment surface on each link engaging the first abutment surface on the adjacent link to limit pivotal movement of the links in an outward direction so that the unsupported portions of the starting bar will have a free form that lies along the casting path, the second abutment surface at the end of each link engages the second abutment surface on the adjacent link when the links pivot inwardly from said casting path and are out of engagement when the first abutment surface is engaged, whereby slight pivotal movement of the links out of alignment with the casting path is permitted but outward pivotal movement of the links is arrested when the curvature of the casting path is reached, and including a third abutment surface on the pivotally connected ends of each link, the third abutment surface on one link engaging the third abutment surface on the adjacent link when the first abutment surfaces of said links are in engagement, the first and third abutment surfaces on each link being on the opposite sides of the pivot axes of the link pairs.

8. The casting machine set forth in claim 7 where each of said links also has a fourth abutment surface at each end, which are in engagement with the fourth abutment surface on the adjacent link when the second abutment surfaces of the adjacent links are in engagement, the second and fourth abutment surfaces being on the opposite sides of the pivotal connection of the links.

9. The casting machine set forth in claim and including storage means disposed generally above the casting path and including clamping means and withdrawal means, wherein the clamping means comprises first and second roller means for engaging the opposite sides of said starting bar, means for driving said roller means for moving said starting bar away from said withdrawal means, and including means for adjusting the clamping force between said roller means and the starting bar for controlling the rate at which the starting bar will be moved downwardly by gravity toward said withdrawal means.

10. The casting machine set forth in claim 9 wherein said clamping means includes first and second pivotally mounted arms, one of said roller means being mounted on one of said arms to urge the same into engagement with said starting bar.

11. The casting machine set forth in claim 10 wherein each of said links includes upper and lower generally parallel flanges to define upper and lower surfaces on said starting bar, the roller means of said storage means engaging said flanges.

12. The casting machine set forth in claim 11 wherein said support means comprises at least a pair of rollers spaced apart below said mold and along said casting path, one of said flanges on each link engaging said rollers, the remaining portions of said starting bar being self supporting between said pair of rollers.

13. The casting machine set forth in claim 12 wherein each of said links includes a tongue at one end and a groove at the other end for engaging complementary portions of adjacent links so that said flanges provide substantially continuous surfaces to said roller means and said pair of rollers.

14. A continuous casting machine for casting an elongate metal member includes a curved mold oriented vertically and having an arcuate passage with openings at its upper and lower ends, the curvature of the mold passage defining an arcuate casting path for the machine comprising points equidistant from the center of curvature of the mold passage, a starting bar comprising a plurality of pivotally interconnected links, the pivot axes of the pivotally connected adjacent link pairs extending perpendicular to the axis of the casting path, storage means for said starting bar, said storage means including first and second clamping means disposed in spaced apart relation along a continuation of the arcuate casting path for supportingly engaging spaced apart portions of the starting bar, the remaining portions of the starting bar being substantially unsupported, and withdrawal means disposed along said casting path between the mold and the storage means for moving the starting bar from a position below said mold into said storage means, said clamping means comprising first and second roller means for engaging opposite sides of said starting bar, means for driving said roller means for moving said starting bar away from said withdrawal means, and means for adjusting the clamping force between said roller means and said starting bar for controlling the rate at which said starting bar will be moved downwardly by gravity toward said withdrawal means.

15. The casting machine set forth in claim 14 and including a pivotally mounted arm, one of said roller means being mounted on said arm, means for engaging said arm to urge one of said roller means into clamping engagement with said starting bar, and means for locking said roller means to hold said starting bar in the stored position.

16. The casting machine set forth in claim 15 and including support means comprising at least a pair of rollers spaced apart below said mold and along said casting path, said starting bar engaging said rollers and being self-supporting therebetween.

17. The casting machine set forth in claim 16 wherein each of said links includes upper and lower generally parallel flanges to define upper and lower surfaces on said starting bar, the roller means of said storage means engaging said flanges, one of the flanges on each link also engaging the rollers of the support means.

* * * * *